US010695777B2

(12) United States Patent
Sauer

(10) Patent No.: US 10,695,777 B2
(45) Date of Patent: Jun. 30, 2020

(54) DEVICE FOR APPLYING A VISCOUS MATERIAL

(71) Applicant: Atlas Copco IAS GmbH, Bretten (DE)

(72) Inventor: Bernhard Sauer, Oelbronn-Duerrn (DE)

(73) Assignee: Atlas Copco IAS GmbH, Bretten (DE)

( * ) Notice: Subject to any disclaimer, the term of this patent is extended or adjusted under 35 U.S.C. 154(b) by 88 days.

(21) Appl. No.: 16/302,249

(22) PCT Filed: May 12, 2017

(86) PCT No.: PCT/EP2017/061440
§ 371 (c)(1),
(2) Date: Nov. 16, 2018

(87) PCT Pub. No.: WO2017/220251
PCT Pub. Date: Dec. 28, 2017

(65) Prior Publication Data

US 2019/0270099 A1 Sep. 5, 2019

(30) Foreign Application Priority Data

Jun. 23, 2016 (DE) ..... 10 2016 007 638

(51) Int. Cl.
*B05B 3/02* (2006.01)
*B05C 5/02* (2006.01)

(52) U.S. Cl.
CPC ..... *B05B 3/026* (2013.01); *B05B 3/028* (2013.01); *B05C 5/0216* (2013.01); *B05C 5/0225* (2013.01)

(58) Field of Classification Search
CPC ..... B05B 1/3405; B05B 3/008; B05B 3/02; B05B 3/025–028; B05B 3/12;
(Continued)

(56) References Cited

U.S. PATENT DOCUMENTS 3,094,254 A * 6/1963 Cullen ..... B05C 5/0216 222/504
5,326,037 A * 7/1994 Hour ..... A61L 2/18 239/743

(Continued)

FOREIGN PATENT DOCUMENTS

DE 102 16 631 B4 2/2004
DE 10 2004 062 063 A1 7/2006

(Continued)

OTHER PUBLICATIONS

International Search Report of PCT/EP2017/061440, dated Sep. 1, 2017, with English translation of relevant parts.

(Continued)

*Primary Examiner* — Cody J Lieuwen
(74) *Attorney, Agent, or Firm* — Collard & Roe, P.C.

(57) ABSTRACT

A device for applying a viscous material has: an application tube, which delimits an application duct running in a longitudinal direction from a material inlet opening to a material outlet opening; and a housing, which accommodates at least part of the application tube and has a material supply connection for the viscous material. The application tube has a first tube section, which is fixed on the housing and has the material inlet opening, and a second tube section, which adjoins the first tube section and has the material outlet opening at a free end. A joint connects the first tube section and the second tube section, and a drive device deflects the free end of the second tube section in a transverse direction running transversely to the longitudinal direction.

10 Claims, 3 Drawing Sheets

Figure 1:
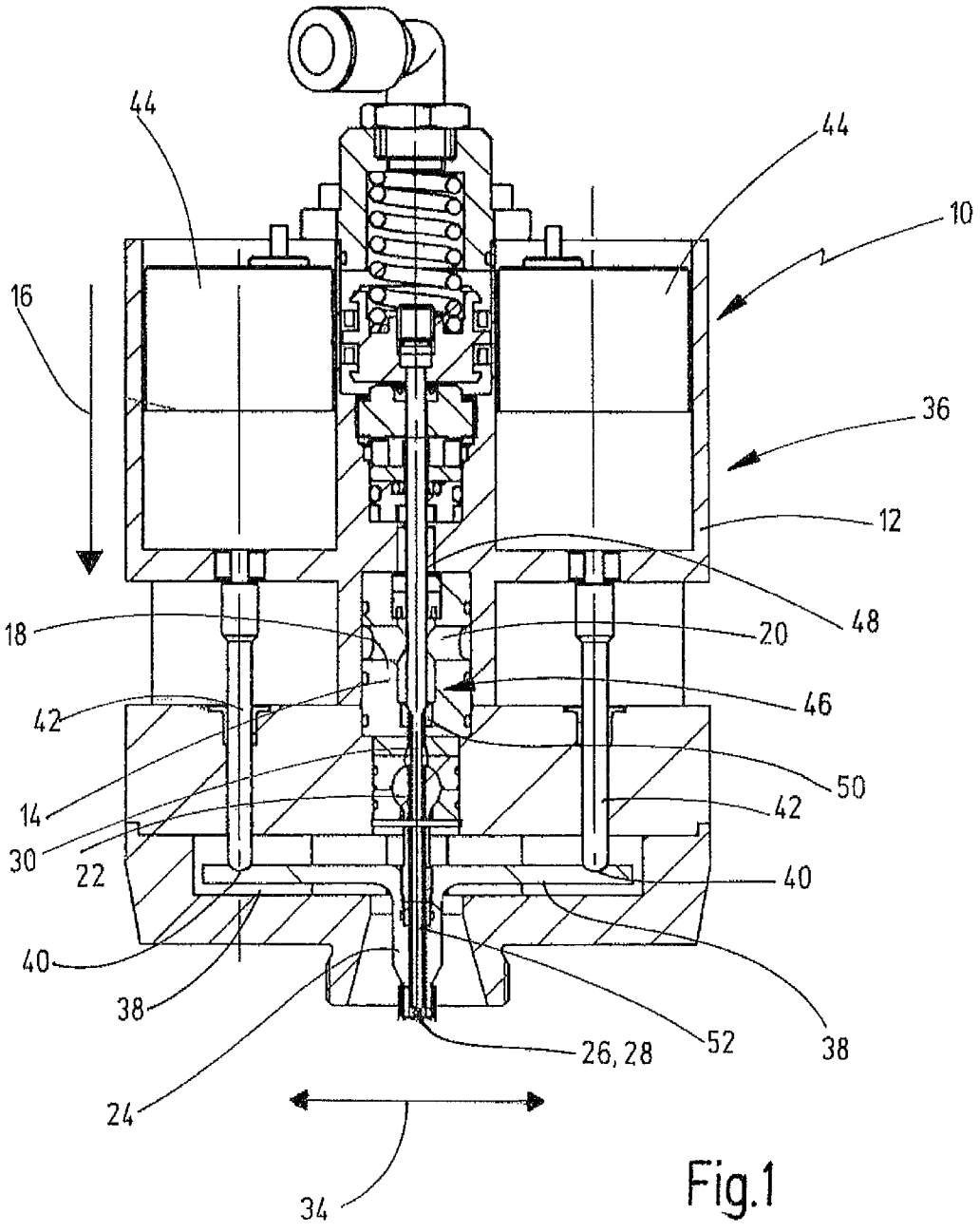

(58) Field of Classification Search
CPC ..... B05B 15/5223; B05B 15/5225; B05C 5/0216; B05C 5/0225
USPC ..... 239/227, 229, 263.1, 263.3, 264, 265, 239/380; 222/333, 526
See application file for complete search history.

(56) References Cited

U.S. PATENT DOCUMENTS

| | | | | |
|---|---|---|---|---|
| 6,021,793 | A * | 2/2000 | Moulder | B05B 3/02 134/167 R |
| 6,758,418 | B2 | 7/2004 | Romanin | |
| 2003/0066910 | A1* | 4/2003 | Romanin | B05B 3/02 239/537 |
| 2015/0367375 | A1* | 12/2015 | Page | B29C 64/106 118/697 |
| 2017/0291180 | A1* | 10/2017 | Kohlhase | B05B 3/1035 |

FOREIGN PATENT DOCUMENTS

| | | | |
|---|---|---|---|
| DE | 20 2007 016 237 | U1 | 2/2008 |
| DE | 10 2013 101 941 | A1 | 8/2014 |
| DE | 10 2014 014 592 | A1 | 4/2016 |
| DE | 10 2014 015 057 | A1 | 4/2016 |
| EP | 0 852 160 | B1 | 7/1998 |

OTHER PUBLICATIONS

German Search Report in DE 10 2016 105 100.4 dated May 8, 2017 with English translation of relevant parts.

* cited by examiner

DEVICE FOR APPLYING A VISCOUS MATERIAL

CROSS REFERENCE TO RELATED APPLICATIONS

This application is the National Stage of PCT/EP2017/061440 filed on May 12, 2017, which claims priority under 35 U.S.C. §119 of German Application No. 10 2016 007 638.0 filed on Jun. 23, 2016, the disclosure of which is incorporated by reference. The international application under PCT article 21(2) was not published in English.

The invention relates to an apparatus for application of a viscous material according to the preamble of claim 1.

Such apparatuses are known from EP 0 852 160 B1, for example, and they find broad use in the application of viscous materials onto workpieces, for example for application of adhesive onto vehicle body parts. For this purpose, an application tube, from the material outlet opening of which the viscous material is applied onto the workpiece, is mounted near its end in a cam, which is driven in rotation around its longitudinal central axis during the application process and forces the eccentrically mounted application tube into a circular motion at its tip provided with the material outlet opening. This circular motion, which takes place at several thousand revolutions per minute, allows centrifugal forces to act on the viscous material and to lead to a spiral motion of the material jet. This causes a circular material application and leads to a breadth of the applied material strand that is substantially greater than the diameter of the material outlet opening. For this purpose, on the one hand the application tube must be elastically flexible at least over a large part of its length, and on the other hand it must have a sufficiently large length that a sufficient deflection of its tip can be achieved. The longer the application tube is, the more material remains therein after completion of the material application and the larger is the application apparatus.

It is therefore the task of the invention to further develop an apparatus of the type mentioned in the introduction in such a way that the application tube can be made shorter.

This task is accomplished according to the invention by an apparatus with the features of claim 1. Advantageous further developments of the invention are subject matter of the dependent claims.

The invention is based on the idea that, by means of the flexible joint, a deflection of the material outlet opening at the free end of the second tube portion may be achieved without the need for the application tube to bend. The second tube portion may then be made quite short, without having to sacrifice, for that purpose, a sufficiently large deflection of its free end relative to a longitudinal central axis of the application tube. The first tube portion may also be made relatively short, in which case merely sufficient length has to be provided that the material can be fed reliably. The shorter construction of the application tube on the whole leads on the one hand to the possibility that the entire apparatus can be made smaller, while on the other hand less residual material remains in the shorter application tube after material application than in a longer application tube. Compared with the prior art, the apparatus according to the invention additionally has the advantage that, with appropriate design and activation of the drive device, the eccentricity of the material outlet opening can be varied infinitely and rapidly. In addition, the application does not necessary take place circularly, but may assume other forms by appropriate activation of the drive device. Finally, the drive device may be switched off, so that the material application may take place in a thin straight line, and the second tube portion may be disposed transversely relative to the first tube portion and held securely in this position, so that an application of the material in a direction transverse to the longitudinal central axis of the first tube portion takes place.

In particular, a ball joint may be considered as a flexible joint. It is also possible, however, to design the flexible joint as a cardan or universal joint or as a flexible joint with an elastic connecting element joining the first tube portion with the second tube portion. For the latter embodiment in particular, a silent block may be considered, in which the tube portions each carry a bush at the ends turned toward one another, wherein the bushes are inserted one into the other and an elastic intermediate layer is disposed between them.

Expediently, the drive device is provided with at least one boom that is securely joined to the second tube portion and that juts out radially, as well as with at least two actuating elements that can be moved by means of respectively one positioning element for urging the at least one boom at various urging points. The boom may be a plate, which surrounds the second tube portion annularly and juts out from it. However, it is preferred that the drive device has a number of booms, corresponding to the number of actuating elements, in the form of boom arms, that jut out radially at an angular spacing relative to one another, so that less material is needed and less mass has to be moved.

When the drive device has only two actuating elements, only a forward and back movement of the material application opening is possible. It is therefore preferred that the drive device has at least three actuating elements, ideally an even larger number, in order to permit movement of the material outlet opening as precisely as possible and also in an approximately circular path. In this connection, it is preferred that both the actuating elements and the urging points are respectively disposed at constant angular spacings relative to one another and to a longitudinal central axis of the application tube, so that a high degree of symmetry is achieved.

Expediently, the actuating elements are tappets capable of moving forward and back and resting loosely on the at least one boom at the urging points. Thus a complex fastening of the actuating elements on at least one boom is not needed. A return stroke of the at least one boom then takes place by urging at a different urging point by means of another tappet. It is also possible, however, that a restoring spring is associated with each tappet for urging of the at least one boom with a restoring force, which is directed toward the tappet and then executes or assists the return stroke.

A large number of usable components may be considered as positioning elements. In particular, it is possible to construct the positioning elements as pneumatic cylinders or piezo elements. However, it is preferred that the positioning elements be moving coils (voice coils), which permit particularly fast activation.

Expediently, the apparatus according to the invention has, for closing the application tube, a needle valve, the valve seat of which is disposed in the first tube portion. In particular, the valve seat may be disposed close to the flexible joint so that, after completion of the application process and closing of the needle valve, only very little residual material capable of dripping out of the material outlet opening remains on the side of the needle valve turned toward the outlet opening. According to one advantageous further development, the needle of the needle valve has a prolongation, which extends into the second tube portion and acts as a displacement member and further reduces the quantity of residual material remaining in the second tube portion after the application process.

Figure 2:
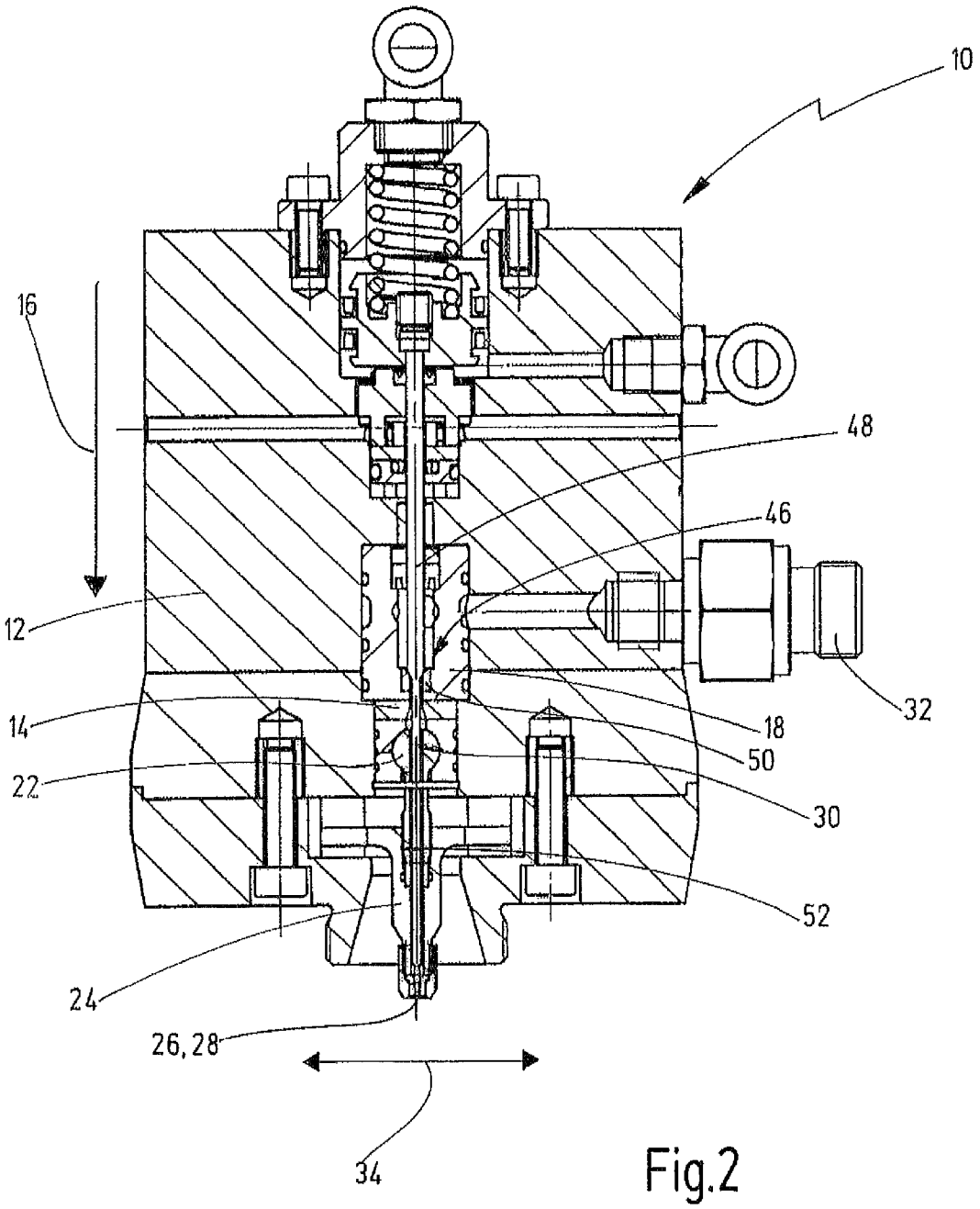
Figure 3:
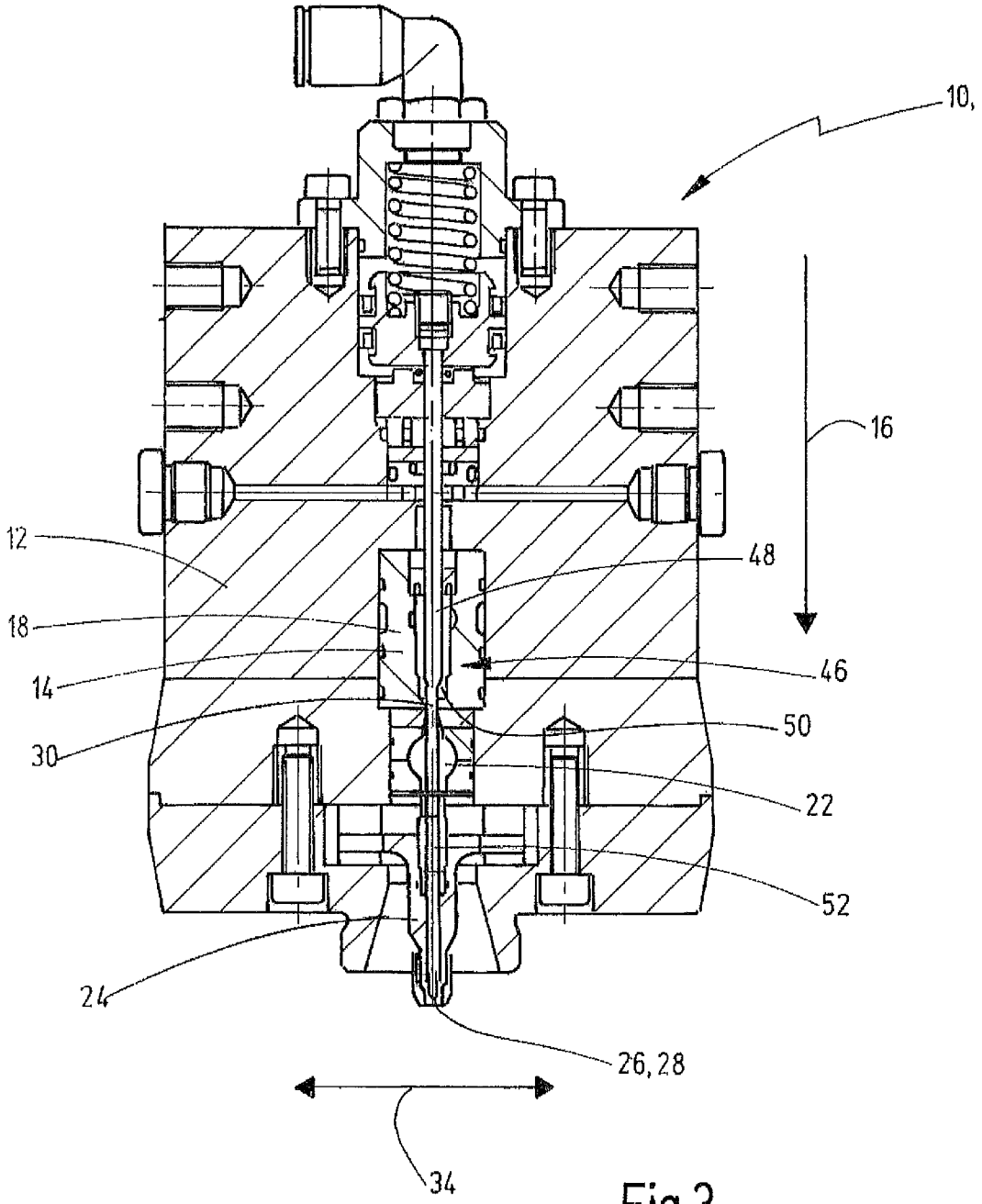

The invention will be explained in more detail hereinafter on the basis of an exemplary embodiment illustrated schematically in the drawing, wherein FIGS. 1 to 3 show an apparatus for application of a viscous material in three different sectional diagrams, wherein the section planes of FIG. 2 and FIG. 3 are perpendicular to one another and include an angle of 45° with the section plane of FIG. 1.

The material application apparatus 10 illustrated in the drawing is used for the application of viscous material such as adhesive or sealing compound onto a workpiece, such as a body part of a motor vehicle, for example. It has a housing 12, in which an application tube 14 is received, which extends in a longitudinal direction 16. The application tube 14 has, disposed fixed to the housing, a first tube portion 18, which has a material inlet opening 20, as well as, joined flexibly to the first tube portion 18 by means of a ball joint 22, a second tube portion 24, which, at its free end 26 turned away from the first tube portion 18, has a material outlet opening 28. Between the material inlet opening 20 and the material outlet opening 28, an application duct 30 for the viscous material extends, which is bounded by an application tube 14 and into which this material is introduced via a material feed port 32 in the housing 12 through the material inlet opening 20.

In order to be able to swivel the second tube portion 24 relative to the first tube portion 18 on the ball joint 22 with deflection of the free end 26 relative to the longitudinal central axis of the application tube 14 in a transverse direction 34 oriented transversely relative to the longitudinal direction 16, a drive device 36 is provided, which has four booms in the form of boom arms 38, which are disposed in cruciform manner at equal angular spacings relative to one another, which are joined to the second tube portion 24 and which jut out radially. Each of the boom arms 38 is urged on its surface, by a tappet 42 resting loosely thereon, at an urging point 40 disposed at a spacing from the second tube portion 24. All urging points 40 are disposed at the same spacing from the second tube portion 24. For movement of the tappets 42, the drive device 36 has, merely indicated in the drawing, four moving coils (voice coils) 44, which are disposed in the housing 12 and each of which is intended to urge one of the tappets 42 for accomplishment of a forward and back motion. Upon an appropriate activation of the moving coils 44, in which the tappets 42 are moved successively in turn downward for urging of the boom arms 38 onto the urging points 40, an approximately circular movement of the free end 26 and thus of the material outlet opening 28 can be achieved. Restoring springs, which act from underneath against the boom arms 38, may be disposed in the housing 12, opposite the tappets 42.

For closing of the application duct 30, a needle valve 46 is provided, the needle 48 of which is seated in a closed position on a valve seat 50 in the first tube portion 18. This valve seat 50 is disposed just above the ball joint 22. A typical value for the spacing of the valve seat 50 from the ball joint 22 is then one to two cm, whereas a typical value for the length of the second tube portion 24 is three to five cm. In addition, the needle 48 has a prolongation 52 of smaller diameter that extends through the ball joint into the second tube portion 24 and that is disposed at sufficient spacing from the second tube portion 24 even during a deflection of the second tube portion 24 by means of swiveling around the ball joint 22 relative to the first tube portion 18. The prolongation 52 acts as a displacement member, in order to minimize the quantity of residual material remaining in the region of the application tube 14 situated between the valve seat 50 and the material outlet opening 28 after the closing of the needle valve 46.

The first tube portion 18 and the second tube portion 24 may each be designed in one piece or, as shown in the exemplary embodiment, be composed of several components. In particular, the first tube portion 18, as illustrated in the drawing, may have a bush, which is disposed at a spacing from the ball joint 22 and in which the material inlet opening 20 is disposed.

In summary, the following may be asserted: The invention relates to an apparatus 10 for application of a viscous material with an application tube 14 bounding an application duct 30 running in a longitudinal direction 16 from a material inlet opening 20 to a material outlet opening 28 and with a housing 12 that receives the application tube 14 at least partly and that has a material feed port 32 for the viscous material, wherein the application tube 14 has a first tube portion 18 disposed fixed to the housing and provided with the material inlet opening 20 and a second tube portion 24 adjoining the first tube portion 18 and provided at a free end 26 with the material outlet opening 28. According to the invention, a flexible joint 22 connecting the first tube portion 18 and the second tube portion 24 is provided, as is a drive unit 36 for deflection of the free end 26 of the second tube portion 24 in a transverse direction 34 oriented transversely relative to the longitudinal direction 16.

The invention claimed is:

1. An apparatus for application of a viscous material, the apparatus comprising:

an application tube bounding an application duct running in a longitudinal direction from a material inlet opening to a material outlet opening;

a housing that receives the application tube at least partly and that has a material feed port for the viscous material, wherein the application tube has a first tube portion disposed fixed to the housing and provided with the material inlet opening and a second tube portion adjoining the first tube portion and provided at a free end with the material outlet opening;

a joint connecting the first tube portion and the second tube portion; and a drive device for deflection of the free end of the second tube portion in a transverse direction oriented transversely relative to the longitudinal direction;

wherein the drive device is provided with at least one boom that is joined to the second tube portion and that juts out radially as well as with at least two actuating elements comprising tappets that can be moved by means of respectively one positioning element for urging the at least one boom at various urging points; and wherein the positioning element comprises a pneumatic cylinder, a piezo element, or a moving coil.

2. The apparatus according to claim 1, wherein the joint is a ball joint, a cardan joint or a joint with an elastic connector joining the first tube portion with the second tube portion.

3. The apparatus according to claim 1, wherein the drive device is provided with at least three actuating elements.

4. The apparatus according to claim 1, wherein the actuating elements and the urging points are respectively disposed at constant angular spacings relative to one another and to a longitudinal central axis of the application tube.

5. The apparatus according to claim 1, wherein the tappets are capable of moving forward and back and resting on the at least one boom at the urging points.

6. The apparatus according to claim 5, wherein a restoring spring is associated with each tappet for urging of the at least one boom with a restoring force, which is directed toward the tappet.

7. The apparatus according to claim 1, wherein the positioning elements are moving coils.

8. The apparatus according to claim 1, wherein the drive device has a number of booms, corresponding to a number of actuating elements, in the form of boom arms, that jut out radially at an angular spacing relative to one another.

9. The apparatus according to claim 1, further comprising a needle valve for closing of the application tube, wherein the needle valve has a valve seat disposed in the first tube portion.

10. The apparatus according to claim 9, wherein the needle valve has a needle comprising a prolongation that extends into the second tube portion.

* * * * *